US006336850B1

(12) United States Patent
Wada et al.

(10) Patent No.: US 6,336,850 B1
(45) Date of Patent: Jan. 8, 2002

(54) SLURRY DISPENSER AND POLISHING APPARATUS

(75) Inventors: Yutaka Wada, Kanagawa-ken; Hirokuni Hiyama, Tokyo; Kazuto Hirokawa; Hisanori Matsuo, both of Kanagawa-ken, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/173,002

(22) Filed: Oct. 15, 1998

(30) Foreign Application Priority Data

Oct. 15, 1997 (JP) ..... 9-297891

(51) Int. Cl.[7] ..... B24B 7/22
(52) U.S. Cl. ..... 451/287; 451/446; 451/60
(58) Field of Search ..... 451/446, 60, 287, 451/288, 41

(56) References Cited

U.S. PATENT DOCUMENTS 5,584,749 A * 12/1996 Mitsuhashi et al. ..... 451/41
5,679,063 A * 10/1997 Kimura et al. ..... 451/60
5,716,264 A * 2/1998 Kimura et al. ..... 451/60
5,868,608 A * 8/1999 Allman et al. ..... 451/72
5,931,725 A * 8/1999 Inaba et al. ..... 451/288
6,007,411 A * 12/1999 Feeney ..... 451/288

FOREIGN PATENT DOCUMENTS

JP 09131661 5/1997

* cited by examiner

*Primary Examiner*—Robert A. Rose
(74) *Attorney, Agent, or Firm*—Wenderoth, Lind & Ponack, L.L.P.

(57) ABSTRACT

A polisher includes a turntable with a polishing surface provided on the top surface of the turntable, an article carrier for holding an article to be polished in such a manner that the article is brought into contact with the polishing surface to polish the article, and a slurry dispenser for receiving and dispensing slurry to the polishing surface. The dispenser includes a slurry dispensing member for dispensing slurry to the polishing surface. The slurry dispensing member includes a contact surface facing and substantially contacting the polishing surface, and a slurry dispensing opening including at least one hole provided in the contact surface to dispense the slurry to the polishing surface therethrough. The opening is sized in such a manner that the opening covers substantially an area of the polishing surface which is to be brought into engagement with the article by relative movement between the article and the polishing surface.

48 Claims, 8 Drawing Sheets

SLURRY DISPENSER AND POLISHING APPARATUS

BACKGROUND OF THE INVENTION

This invention relates to a polisher for polishing an article such as a semiconductor wafer, and in particular, it relates to a slurry dispensing apparatus for dispensing slurry to a polishing surface of the polisher which is brought into contact with and moved relative to an article to thereby polish the article.

A typical prior art polisher includes a turntable with a polishing cloth provided on the top surface thereof constituting a polishing surface, an article carrier for holding an article in such a manner that the article is brought into contact with the polishing surface to polish the article, and a slurry dispenser. In operation, a polishing slurry is dispensed to the polishing surface through a nozzle of the slurry dispenser which is provided above the center portion of the turntable. The slurry dispensed to the center portion of the polishing surface is spread over the polishing surface under the action of a centrifugal force generated by rotation of the turntable.

However, it is difficult to enable the slurry to be spread uniformly over the polishing, surface, and accordingly, it is difficult for an article to be polished uniformly as desired. Further, since it is necessary for the slurry to be spread across the entire polishing surface in an outward direction from the center thereof, a substantial amount of slurry is required to be supplied.

SUMMARY OF THE INVENTION

An object of this invention is therefore to provide a polisher which enables slurry to be spread uniformly and appropriately over an area of the polishing surface to be used in polishing an article, whereby a substantial reduction in an amount of slurry and uniform polishing of an article can be realized.

According to this invention, a polisher includes a turntable with a polishing surface provided on the top surface thereof, an article carrier for holding an article to be polished in such a manner that the article is brought into contact with the polishing surface to polish the article, and a slurry dispenser for receiving and dispensing slurry to the polishing surface. The dispenser includes a slurry dispensing member for dispensing slurry to the polishing surface which includes a contact surface facing and substantially contacting the polishing surface, and a slurry dispensing opening including at least one hole provided in the contact surface for dispensing the slurry to the polishing surface therethrough.

The opening may be sized in such a manner that it substantially covers substantially an area of the polishing surface which is to be brought into engagement with the article by relative movement between the article and the polishing surface. The dispenser may include a positioning device for positioning the slurry dispensing member in such a manner that the contact surface thereof is pressed against the polishing surface. Further, the slurry dispensing member may include a slurry container portion for containing slurry therein and which is in fluid communication with the above noted opening. The container portion may be divided into a plurality of container sections which are in fluid communication with the opening. The dispenser may comprise a slurry supply device connected to a slurry supply for supplying slurry to the container sections. The slurry supply device may include a plurality of slurry supply paths for connecting the slurry supply to the respective container sections, and an adjusting device for adjusting amounts of slurry to be supplied to the respective container sections through the slurry supply paths. The adjusting device may include valves provided in the respective slurry supply paths which individually adjust the amount of slurry to be supplied to the corresponding container sections.

DETAILED DESCRIPTION OF THE INVENTION

The invention will be explained with reference to the attached drawings.

Figure 1:
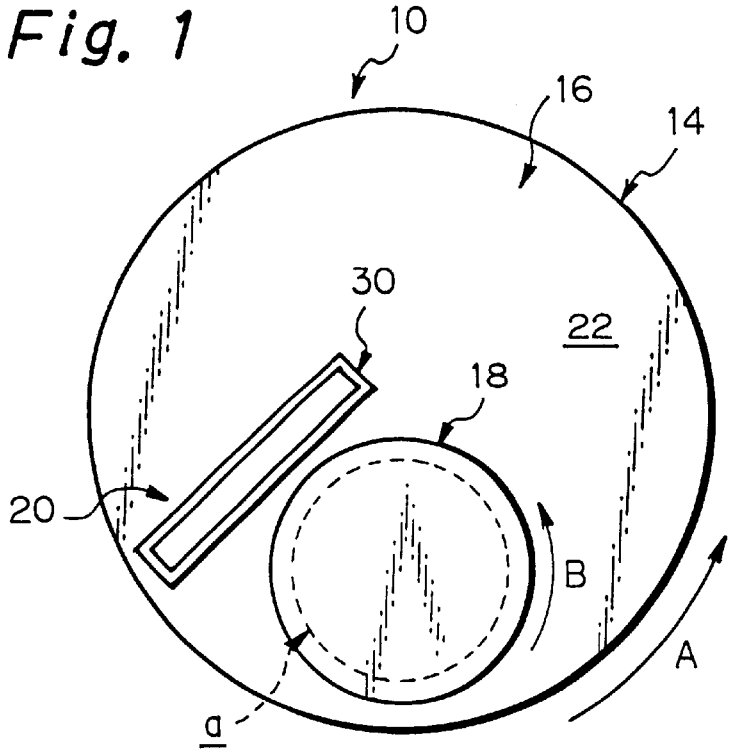
FIG. 1 is a plan view of a polisher in accordance with a first embodiment of the present invention.
Figure 2:
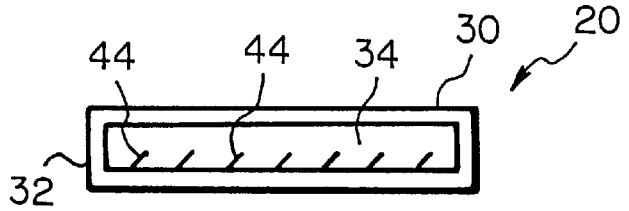
FIG. 2 is a plan view of a slurry dispensing member of a slurry dispenser of the polisher shown in FIG. 1.
Figure 3:
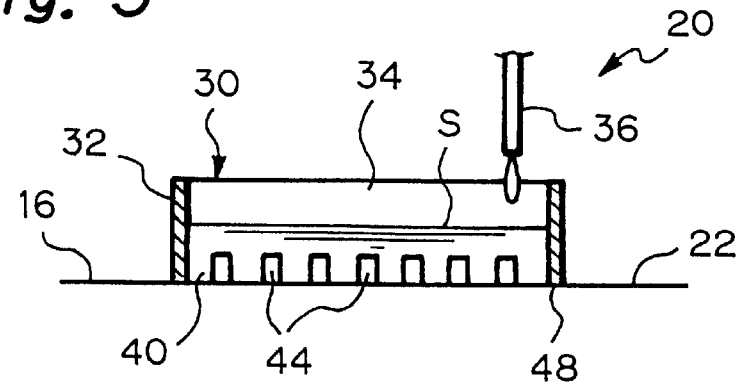
FIG. 3 is a cross sectional side elevational view of the slurry dispensing member.

FIGS. 1 through 3 show a polisher 10 in accordance with a first embodiment of this invention. The polisher 10 includes a turntable 14 with a polishing cloth 16 provided over the top surface of the turntable 14, a rotatable carrier 18 provided above the polishing cloth 16 for holding an article a to be polished such as a semiconductor wafer, and a slurry dispenser 20 provided above the polishing cloth, only a part of which is shown for clarification. In operation, the turntable is rotated about its axis in a direction designated by an arrow "A", and the rotatable carrier 18 is rotated about its axis in a direction designated by an arrow "B" keeping the article a held by the carrier 18 in contact with the polishing surface 22 as defined by an upper surface of the polishing cloth 16. The slurry dispenser 20 is positioned upstream of the rotatable carrier 18 in the direction "A" of rotation of the turntable 14.

The slurry dispenser 20 includes a slurry dispensing member 30 which is rectangular as viewed in FIGS. 1 and 2, has a vertical surrounding wall 32, and is elongated substantially in a radial direction of the turntable 14. The slurry dispensing member 30 includes a container portion 34 having a slurry containing cavity defined by the vertical surrounding wall 32 for containing polishing slurry s supplied through a supply nozzle 36, and an elongated hole 40 at the bottom surface 48 of the slurry dispensing member 30 which is fluidly connected to the slurry containing cavity of the container portion 34. In this embodiment, the hole 40 is formed as an extension of the slurry containing cavity of the container portion 34. The slurry dispensing member 30 further includes a plurality of blades 44 provided on an inner surface of a portion of the surrounding wall 32 which is positioned at the downstream side of the slurry containing cavity in the direction "A" of rotation of the turntable 14.

The blades 44 slant relative to the inner surface, and are connected to the inner surface at their radially outer ends. The blades 44 also vertically extend from a lower portion of the inner surface, with the lower ends of the blades 44 being flush with the lower portion of the hole 40, i.e., the bottom surface 48 of the slurry dispensing member 30. The blades 44 prevent the slurry contained in the slurry dispensing member 30 from being influenced by forces imposed on the slurry as a result of rotation of the turntable 14, to thereby enable the slurry to be appropriately dispensed to the polishing surface 22.

The slurry dispenser 20 further includes a positioning device (not shown) adapted to position the slurry dispensing member 30 in such a manner that the bottom surface 48 of the dispensing member 30 defining the lower portion of the hole 40 is pressed against the polishing cloth 16 so that the slurry contained in the slurry dispensing member 30 rarely flows out from the hole 40 when the turntable 14 is not being rotated, but rather flows out to adhere to the polishing surface 22 when the turntable 14 is being rotated. As a result, the slurry dispensed onto the polishing surface 22 forms a uniform thin layer of slurry on the polishing surface 22. However, it is not necessarily required for the bottom surface 48 to be pressed against the polishing cloth 16. It is necessary for the bottom surface 48 to substantially contact the polishing surface 22 of the polishing cloth 16 to make it possible to control a flow of the slurry exiting from the hole 40.

A shown in FIG. 1, the slurry dispensing member 20 extends in a radial direction of the turntable 14 over an area of the polishing surface 22 which is to be brought into contact with the article a held by the carrier 18.

FIGS. 4 through 7 show a polisher 110 in accordance with a second embodiment of the present invention. As shown, the polisher 110 is generally similar to that of the first embodiment and includes a turntable 114 with a polishing cloth 116, an article carrier 118 and a slurry dispenser 120 including a slurry dispensing member 130. In this embodiment, the slurry dispensing member 130 includes a plurality of partitions 162 to divide a slurry container portion 134 of the slurry dispensing member 130 into a pluarlity of container sections 160 which are arranged in a radial direction of the turntable 114 as viewed in FIG. 4. A cover plate 166 is provided at the top of the slurry dispensing member 130. Each of the container sections 160 is fluidly connected to a vertically aligned corresponding hole 140 which in defined in the bottom portion of the slurry dispensing member 130 as an extension of the container section 160.

Figure 4:
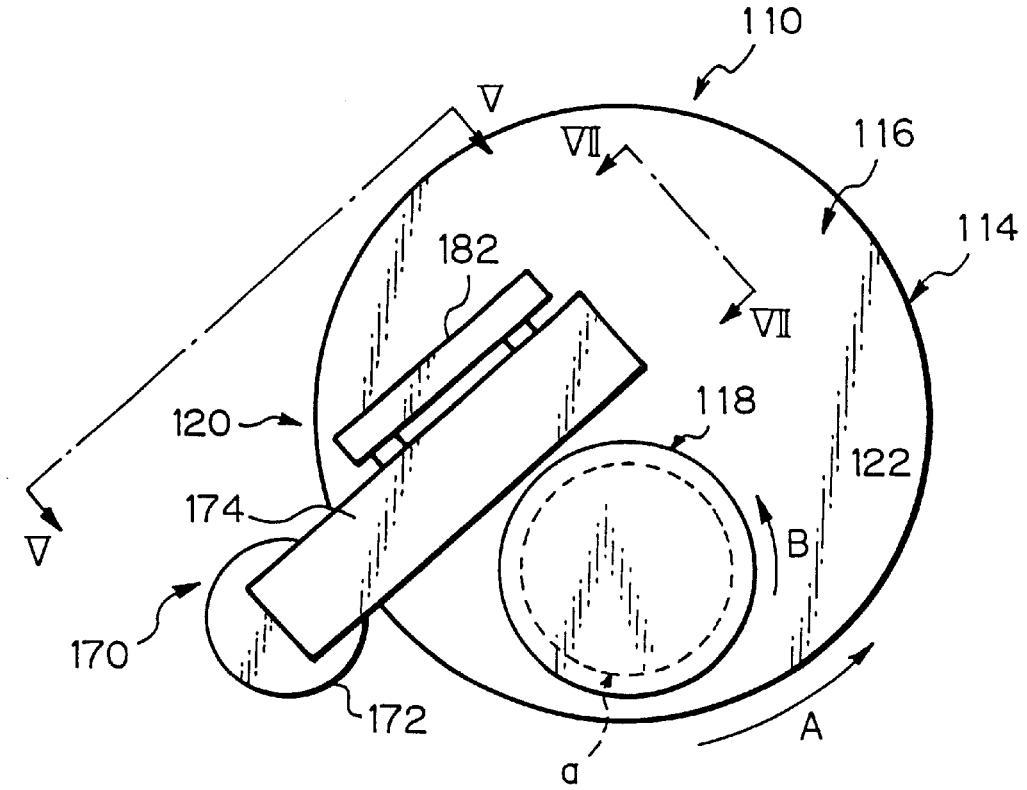
FIG. 4 is a plan view of a polisher in accordance with a second embodiment of the present invention.
Figure 5:
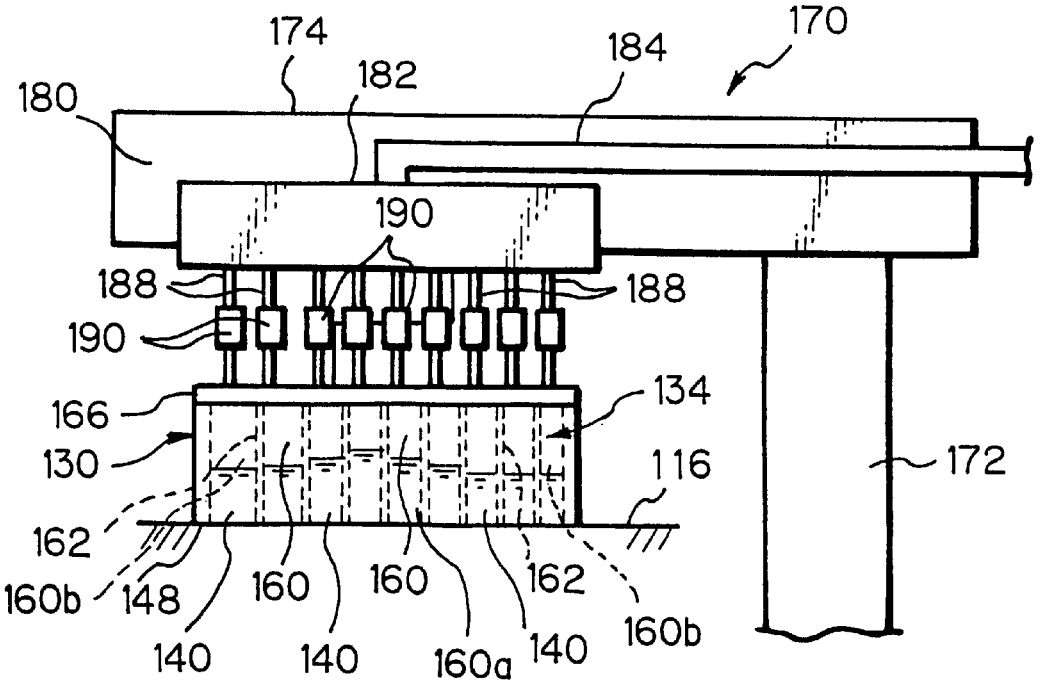
FIG. 5 is a view taken along a line V—V in FIG. 4.
Figure 6:
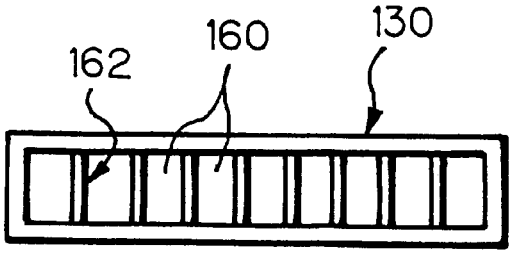
FIG. 6 is a plan view of a slurry dispensing member of a slurry dispenser in the polisher shown in FIG. 4.
Figure 7:
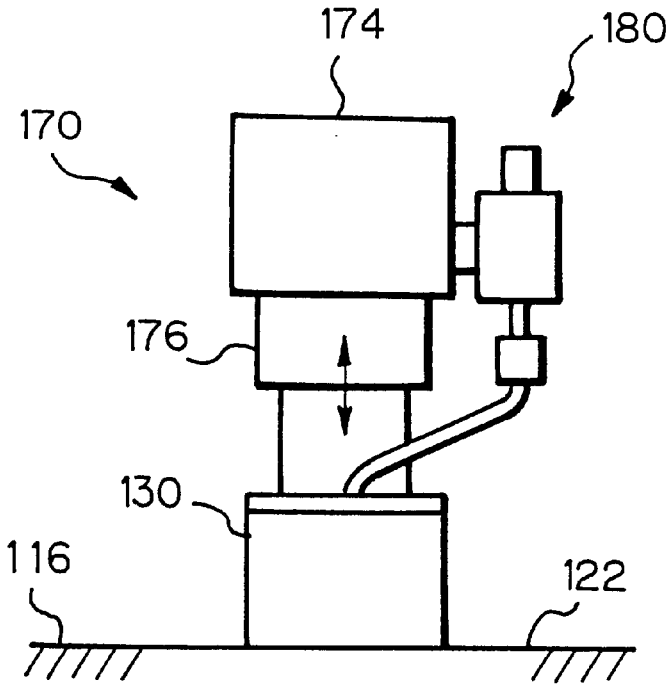
FIG. 7 is a view taken along a line VII—VII in FIG. 4.

In FIGS. 4, 5 and 7, there is shown a positioning device 170 for positioning the slurry dispensing member 130 relative to a polishing surface 122 of the turntable 114, which positioning device is, as stated above, omitted from FIGS. 1 through 3 for the sake of clarity. The positioning device 170 includes a pivot column 172 vertically provided adjacent to the turntable 114, a horizontal arm 174 provided at the top and of the column 172 and rotatable about an axis of the pivot column 172 and an extendible vertical rod 176 having the construction of a piston/cylinder as shown in FIG. 7 connected between the arm 174 and the slurry dispensing member 130. The slurry dispensing member 130 is, therefore, rotatable about the axis of the pivot column 172 and movable up and down, whereby the slurry dispensing member 130 can be positioned in such a manner that the slurry dispensing member 130 extends generally in a radial direction of the turntable 114 and the bottom surface 148 thereof is pressed against the polishing cloth 116 of the turntable 114 as stated in connection with the first embodiment.

The slurry dispenser 120 further includes a slurry supply device 180 for supplying slurry into the container portion 134 of the slurry dispensing member 130. The slurry supply device 180 includes a slurry reservoir 182 provided on a side wall of the arm 174, and is fluidly connected to a slurry supply (not shown) through a pipe 184. Slurry distributing paths or pipes 188 are fluidly connected to the reservoir 182 at the upper end thereof and to corresponding ones of the container sections 160 at the lower end thereof, so as to supply slurry from the reservoir 182 to the respective container sections 160.

Figure 8A:
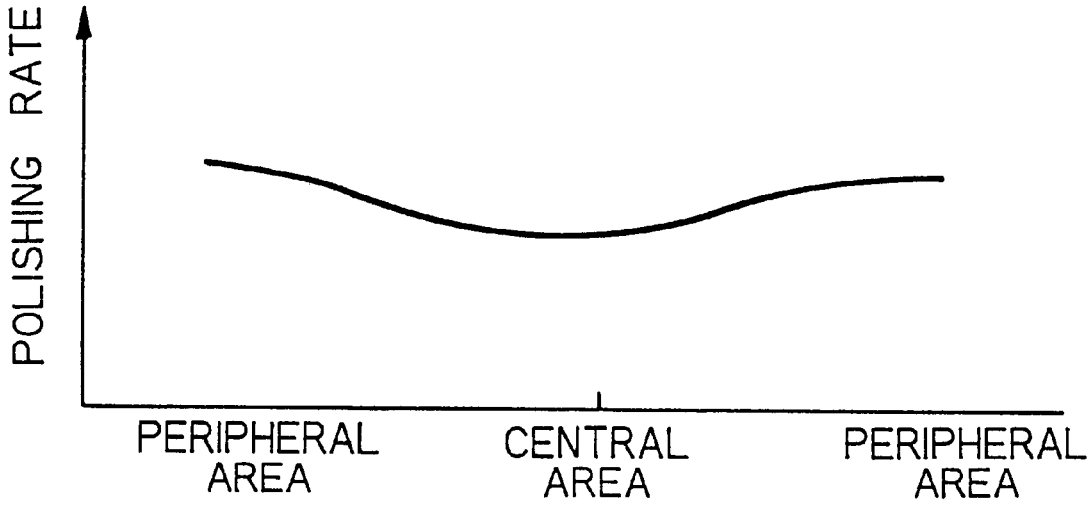
FIG. 8*a* is a graph showing an example of polishing rates along a diameter of a surface of an article being polished.
Figure 8B:
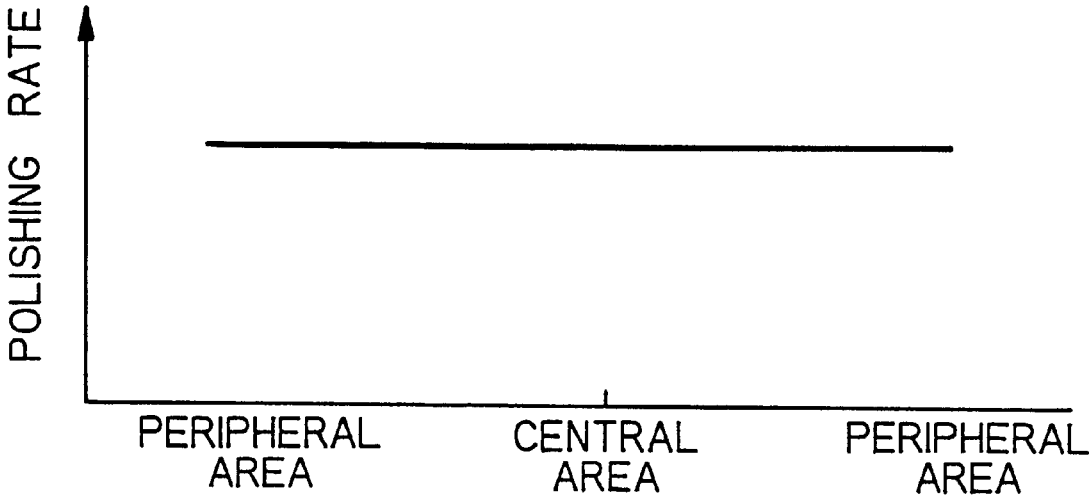
FIG. 8*b* is a graph showing the polishing rates along the diameter of the surface which has been rectified by adjusting amounts of slurry supplied to a polishing surface contacting the surface of the article.

Each of the slurry distributing paths 188 includes a solenoid operated open/close valve 190 to thereby individually control an amount of slurry to be supplied to the corresponding container section 160 by adjusting a time during which the valve 190 is opened. When it is determined that a polishing rate of the central area of a circular surface of an article or a cylindrical semiconductor wafer to be polished is, as shown in FIG. 8*a*, smaller than that of the peripheral area of the same, the central container section 160*a* and the container sections adjacent to the central container section 160*a* are, as shown in FIG. 5. supplied with relatively large amounts of slurry, and the opposite end container sections 160*b* and the container sections adjacent to the opposite end container sections 160*b* are supplied with relatively small amounts of slurry, so that the central container section 160*a* and the container sections adjacent thereto will dispense a relatively large slurry to the polishing surface 122 while the opposite end container sections 160*b* and the container sections adjacent thereto will provide a relatively small amount of slurry, whereby the polishing rate becomes substantially uniform as shown in FIG. 8*b* over the circular surface of the semiconductor wafer a.

Figure 9A:
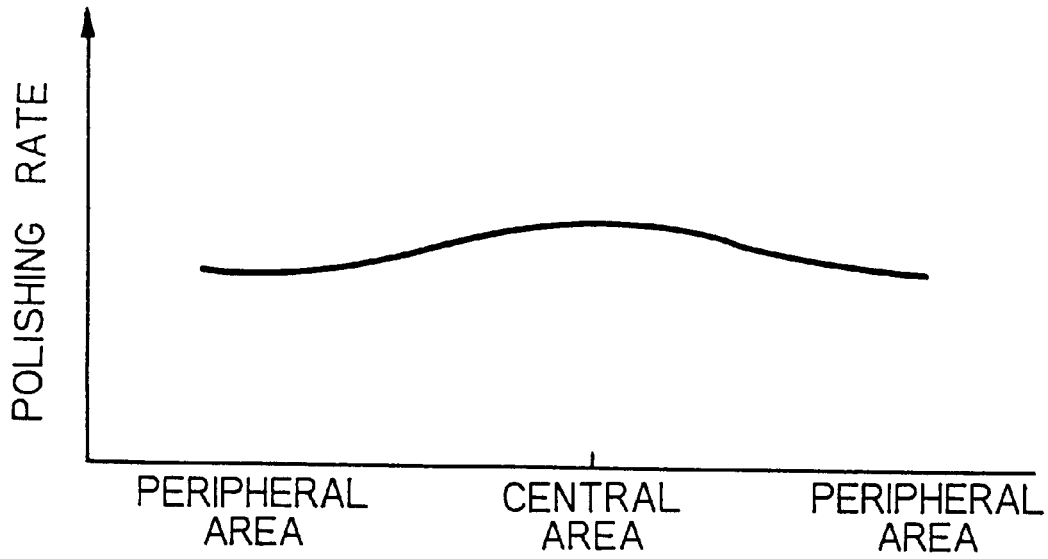
FIG. 9*a* is a graph showing another example of polishing rates along a diameter of a surface of an article being polished.
Figure 9B:
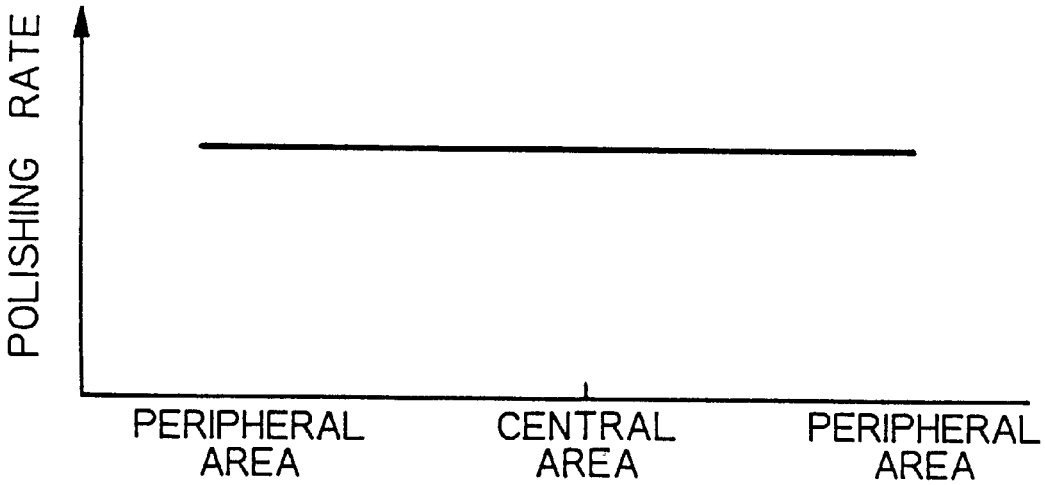
FIG. 9*b* is a graph showing the polishing rates along the diameter of the surface which has been rectified by adjusting amounts of slurry supplied to a polishing surface contacting the surface of the article.

To the contrary, when it is determined that a polishing rate of the central area of the circular surface of the cylindrical semiconductor wafer a to be polished is, as shown in FIG. 9*a*, larger than that of the peripheral area of the same, the central container section 160*a* and the container sections adjacent thereto are supplied with relatively small amounts of slurry, and the opposite end container sections 160*b* and the container sections adjacent thereto are supplied with relatively large amounts of slurry, so that the central container section 160*a* and the container sections adjacent thereto will dispense a relatively small amount of slurry to the polishing surface 122 while the opposite end container sections 160*b* and the container sections adjacent thereto will provide relatively large amounts of slurry, whereby the polishing rate becomes substantially uniform as shown in FIG. 9*b* over the circular surface of the semiconductor wafer a. In the above-noted second embodiment, the open/close valve 190 may be replaced by a flow rate control valve.

Figure 10:
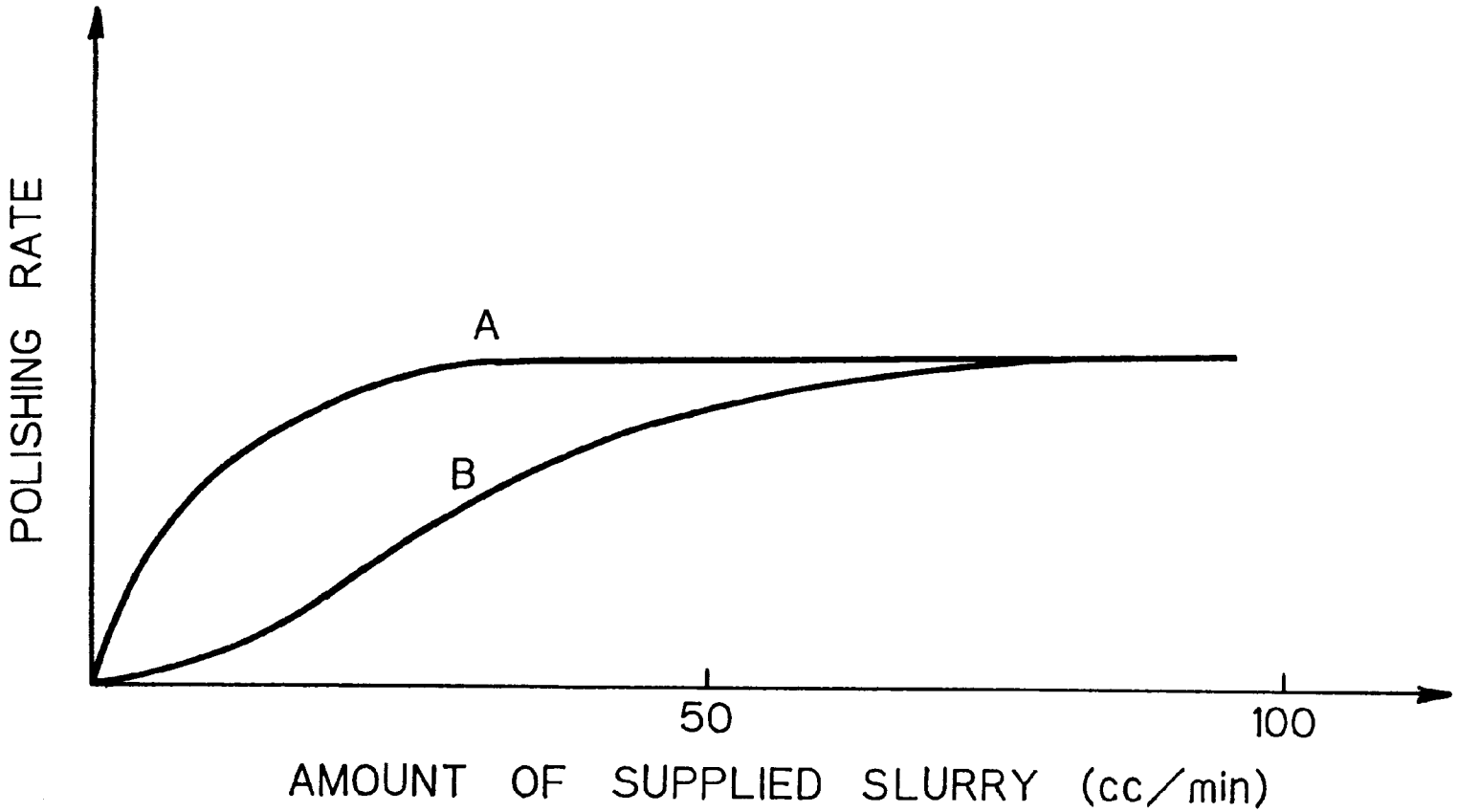
FIG. 10 is a graph showing relationships between polishing rates and amounts of supplied slurry in a polisher of the present invention and a prior art polisher.

According to the present invention, slurry is dispensed in an effective manner as stated above and consequently it is possible to conduct polishing of an article with a small amount of slurry as compared with a prior art polisher as stated above. FIG. 10 shows such relationships between amounts of distributed slurries and polishing rates in the present invention and the prior art. The curves "A" and "B" designating the relationships in the present invention and in the prior art, respectively. As can be seen from these curves, in accordance with the present invention, higher polishing rates are achieved with smaller amounts of slurry as compared with the prior art.

Figure 11:
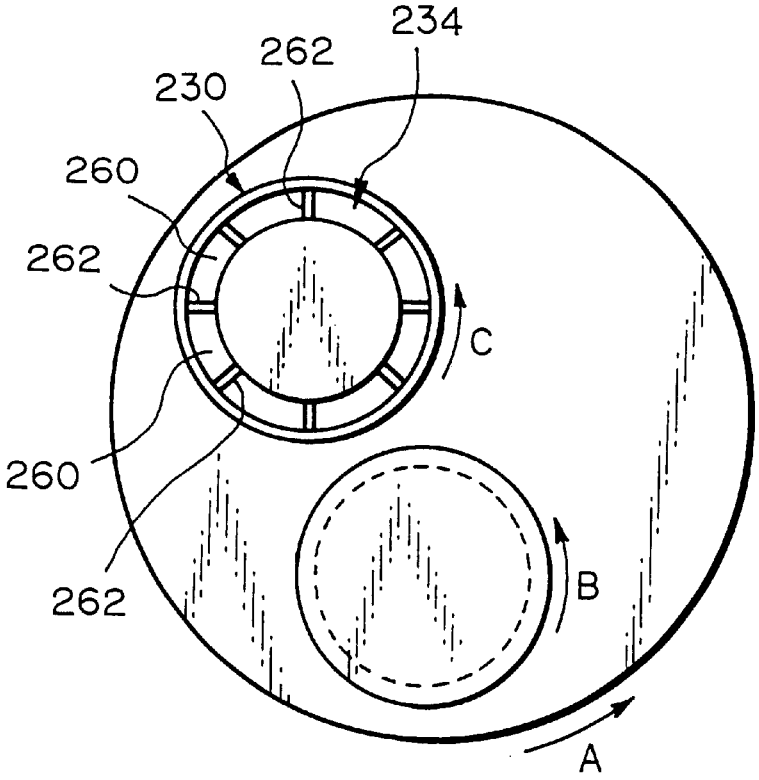
FIG. 11 is a plan view of a polisher in accordance with third embodiment of the present invention.
Figure 12:
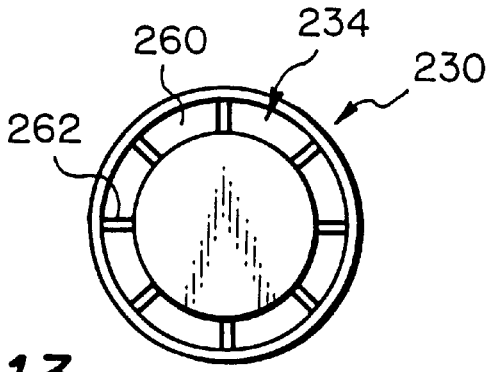
FIG. 12 is a plan view of a slurry dispensing member of a slurry dispenser of the polisher shown in FIG. 11.
Figure 13:
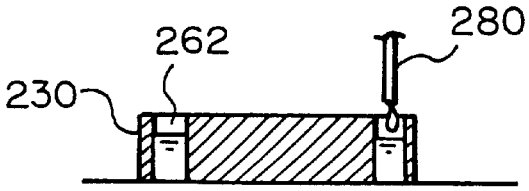
FIG. 13 is a cross-sectional side elevational view of the slurry dispensing member of FIG. 12.

FIGS. 11 through 13 show another embodiment of the present invention in which a dispensing member 230 is in the shape of a circle and rotatable about an axis thereof in the direction designated by an arrow "C". The dispensing member 230 includes a circular container portion 234 which in divided by a plurality of partitions 262 into a plurality of container sections 260 arranged in a circle. In this embodiment, the center portion is solid, however, it is possible to make it hollow. At least one slurry nozzle 280 is provided at a particular angular position relative to the circular slurry dispensing member 230 under which the container sections 260 pass successively when the circular slurry dispensing member 230 is rotated, whereby the container sections 260 are uniformly supplied with slurry by the slurry nozzle 280. The circular dispensing member 230 is positioned upstream of an article carrier 218 for holding an article a to be polished. The dispensing member 230 has a circular slurry dispensing opening at the bottom surface thereof which consists of holes which are formed under the container sections 260 as their extensions. The diameter of the circular opening is substantially the same as that of the article so that the circular opening covers an area of a polishing cloth which is to be brought into contact with the article by rotation of a turntable about its axis.

Figure 14:
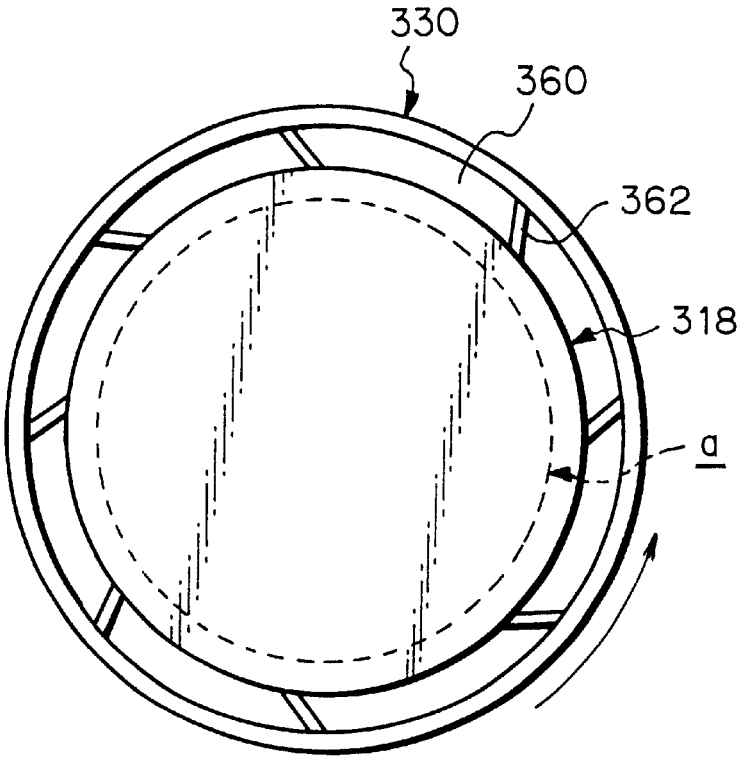
FIG. 14 is a plan view of a slurry dispensing member in accordance with the fourth embodiment of the present invention; and, FIG. 15 is a cross-sectional side elevational view of the slurry dispensing member shown in FIG. 14.
Figure 15:
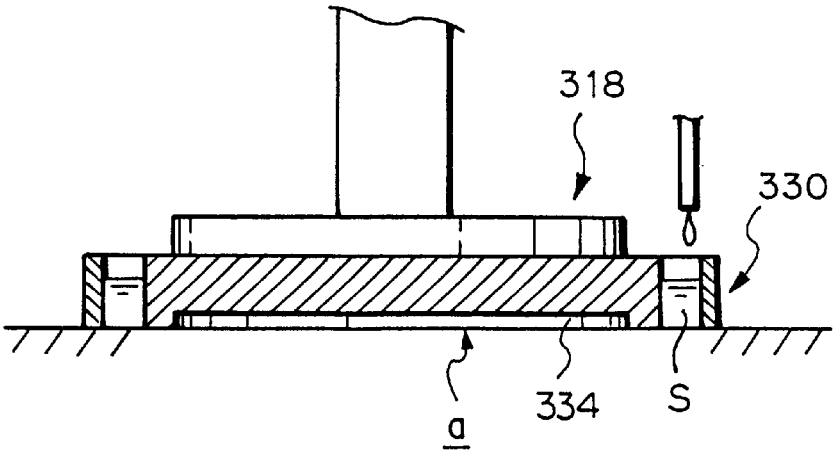

FIGS. 14 and 15 show a slurry dispensing member 330 in accordance with the fourth embodiment of the present invention. The slurry dispensing member 330 is in the shape of a ring and integrally formed around a circular rotatable article carrier 318 which is adapted to hold an article a to be polished in a recess 334 formed in the bottom of the article carrier 318. The dispensing member 330 is generally the same as that of FIGS. 12 and 13 in construction except that partitions 362 defining container sections 360 are slanted. The slurry dispensing member 330 may be rotatably provided around the article carrier 318 so that the dispensing member 330 can be rotated independently of the article carrier.

It is preferable for the slurry dispensing members 30, 130. 230 and 330 as stated above to be rigid to an extent that the dispensing members are not easily deformed under a pressure applied thereto to press them against a polishing cloth. Further, it is preferable for the dispensing members to be corrosion resistant and to be able to sealingly engage with the polishing cloth. It is therefore preferable to use as a material of the slurry dispensing members, for instance, a plastic material selected from polycarbonate, polyvinyle chrolide, polypropylene, polytetrafluoroethylene and so on, or a steel coated with such a plastic material. The polishing cloth may be covered with a rubber sheets Although in the first, third and fourth embodiments, a slurry is supplied to the slurry dispensing member in a batch manner, the slurry may be supplied in a continuous manner as in the second embodiment. In such a case, it is preferable to provide a level sensor in a container potion of a slurry dispensing member to automatically control the level of the slurry.

Although this invention has been explained with reference with the drawings, the entire disclosure of Japanese Patent Application H9-297891 filed on Oct. 15, 1997 including specification, claims, drawings and summary is incorporated herein by reference to its entirety.

What is claimed is:

1. A slurry dispenser for dispensing slurry to a polishing surface of a polishing apparatus, wherein an article is to be brought into contact with and moved relative to the polishing surface such that the article becomes polished, said slurry dispenser comprising:

a slurry dispensing member to receive slurry and dispense the slurry to the polishing surface, wherein the slurry dispensing member includes slurry dispensing openings through which the slurry is to be respectively supplied to areas on the polishing surface that correspond to respective portions of the article to be polished, and also includes a slurry supply adjuster to individually adjust an amount of slurry to be supplied to respective ones of the areas through respective said slurry dispensing openings.

2. The slurry dispenser according to claim 1, and further comprising a slurry reservoir in fluid communication with said slurry dispensing member via a plurality of paths, with respective ones of said plurality of paths being in fluid communication with respective ones of said slurry dispensing openings.

3. The slurry dispenser according to claim 2, wherein said slurry supply adjuster includes a valve positioned within each of said plurality of paths to individually control an amount of slurry that is supplied from said slurry reservoir to said slurry dispensing openings.

4. A method for dispensing slurry to a polishing surface of a polishing apparatus in which an article to be polished is brought into contact with and moved relative to the polishing surface, such that the article becomes polished, said method comprising:

individually adjustably supplying slurry to respective areas on said polishing surface that are to be brought into contact with respective corresponding portions of said article.

5. The method according to claim 4, wherein individually adjustably supplying the slurry to respective areas on said polishing surface results in adjustably supplying the slurry to a central portion of said article independently of adjustably supplying the slurry to a peripheral portion of said article.

6. The method according to claim 4, wherein individually adjustably supplying the slurry to respective areas on said polishing surface includes feeding the slurry from a slurry reservoir through a plurality of paths, and then through respective slurry dispensing openings in a slurry dispenser member.

7. The method according to claim 6, wherein individually adjustably supplying the slurry to respective areas on said polishing surface further includes individually adjusting an amount of the slurry fed from said slurry reservoir through each of said plurality of paths.

8. The method according to claim 7, wherein individually adjusting an amount of the slurry fed from said slurry reservoir through each of said plurality of paths includes individually adjusting the amount of slurry fed from said slurry reservoir through each of said plurality of paths such that a polishing rate becomes substantially uniform over an area of the article being polished.

9. A polisher comprising:

a turntable having a polishing surface positioned on a top surface thereof;

an article holder to hold an article to be polished by bringing the article into contact with said polishing surface; and a slurry dispenser to dispense the slurry to said polishing surface, wherein the slurry dispenser includes slurry dispensing openings radially arranged relative to said turntable, and also includes a slurry supply adjuster to individually adjust an amount of slurry to be supplied through said slurry dispensing openings to respective areas of said polishing surface.

10. The polisher according to claim 9, and further comprising a slurry reservoir in fluid communication with said slurry dispenser via a plurality of paths, with a respective one of said plurality of paths being in fluid communication with a respective one of said slurry dispensing openings.

11. The polisher according to claim 10, wherein said slurry supply adjuster includes a valve positioned within each of said plurality of paths to individually control an amount of slurry that is supplied from said slurry reservoir to said slurry dispensing openings.

12. A method for dispensing slurry to a polishing surface of a turntable of a polishing apparatus in which an article to be polished is brought into contact with and moved relative to the polishing surface such that the article becomes polished, said method comprising:

individually adjustably supplying slurry to respective areas on said polishing surface that are to be brought into contact with respective corresponding portions of said article.

13. The method according to claim 12, wherein individually adjustably supplying the slurry to respective areas on said polishing surface results in adjustably supplying the slurry to a central portion of said article independently of adjustably supplying the slurry to a peripheral portion of said article.

14. The method according to claim 12, wherein individually adjustably supplying the slurry to respective areas on said polishing surface includes feeding the slurry from a slurry reservoir through a plurality of paths, and then through respective slurry dispensing openings in a slurry dispenser.

15. The method according to claim 14, wherein individually adjustably supplying the slurry to respective areas on said polishing surface further includes individually adjusting an amount of the slurry fed from said slurry reservoir through each of said plurality of paths.

16. The method according to claim 15, wherein individually adjusting an amount of the slurry fed from said slurry reservoir through each of said plurality of paths includes individually adjusting the amount of slurry fed from said slurry reservoir through each of said plurality of paths such that a polishing rate becomes substantially uniform over an area of the article being polished.

17. A polisher comprising:

a polishing member having a polishing surface;

an article holder to hold an article to be polished by bringing the article into contact with said polishing surface and moving said polishing member relative to the article; and a slurry dispenser to dispense the slurry to said polishing surface, wherein the slurry dispenser includes slurry dispensing openings through which the slurry is to be respectively supplied to areas on the polishing surface that correspond to respective portions of the article to be polished, and also includes a slurry supply adjuster to individually adjust an amount of slurry to be supplied to respective ones of the areas through respective said slurry dispensing openings.

18. The polisher according to claim 17, and further comprising a slurry reservoir in fluid communication with said slurry dispenser via a plurality of paths, with a respective one of said plurality of paths being in fluid communication with a respective one of said slurry dispensing openings.

19. The polisher according to claim 18, wherein said slurry supply adjuster includes a valve positioned within each of said plurality of paths to individually control an amount of slurry that is supplied from said slurry reservoir to said slurry dispensing openings.

20. A slurry dispenser for dispensing slurry to a polishing surface of a polishing apparatus wherein an article is to be brought into contact with and moved relative to the polishing surface such that the article becomes polished, said slurry dispenser comprising:

a slurry dispensing member to receive slurry and dispense the slurry to the polishing surface, wherein said slurry dispensing member includes a contact surface having at least one opening therein, and is constructed and arranged to face and contact the polishing surface as the slurry is dispensed through said at least one opening and onto the polishing surface, wherein said slurry dispensing member includes a slurry container portion to hold the slurry therein, with said slurry container portion being in fluid communication with said at least one opening, and wherein said slurry container portion is divided into a plurality of container sections, and wherein said at least one opening includes a plurality of openings, with said plurality of openings being in fluid communication with said plurality of container sections, respectively.

21. The slurry dispenser according to claim 20, and further comprising a slurry supply device to supply the slurry to said plurality of container sections.

22. The slurry dispenser according to claim 21, wherein said slurry supply device includes a plurality of slurry supply paths in fluid communication with said plurality of container sections, respectively, and an adjusting device to adjust the amount of slurry supplied to a respective one of said plurality of container sections.

23. The slurry dispenser according to claim 22, wherein said adjusting device includes valves positioned in respective ones of said plurality of slurry paths.

24. A polisher comprising:

a turntable having a polishing surface positioned on a top surface thereof;

an article holder to hold an article to be polished by bringing the article into contact with said polishing surface; and a slurry dispenser to dispense slurry to said polishing surface, wherein said slurry dispenser includes a slurry dispensing member to receive slurry and dispense the slurry to the polishing surface, with said slurry dispensing member including a contact surface having at least one opening therein, such that said contact surface faces and contacts said polishing surface as the slurry is dispensed through said at least one opening and onto the polishing surface, wherein said slurry dispensing member also includes a slurry container portion to hold the slurry therein, with said slurry container portion being in fluid communication with said at least one opening, and wherein said slurry container portion is divided into a plurality of container sections, and wherein said at least one opening includes a plurality of openings, with said plurality of openings being in fluid communication with said plurality of container sections, respectively.

25. The polisher according to claim 24, wherein said slurry dispenser further includes a slurry supply device to supply the slurry to said plurality of container sections.

26. The polisher according to claim 25, wherein said slurry supply device includes a plurality of slurry supply paths in fluid communication with said plurality of container sections, respectively, and an adjusting device to adjust the amount of slurry supplied to a respective one of said plurality of container sections.

27. The polisher according to claim 26, wherein said adjusting device includes valves positioned in respective ones of said plurality of slurry paths.

28. A polisher comprising:

a turntable having a polishing surface positioned on a top surface thereof;

an article holder to hold an article to be polished by bringing the article into contact with said polishing surface; and a slurry dispenser to dispense slurry to said polishing surface, wherein said slurry dispenser includes a slurry dispensing member to receive slurry and dispense the slurry to the polishing surface, with said slurry dispensing member including a contact surface having at least one opening therein, such that said contact surface faces and contacts said polishing surface as the slurry is dispensed through said at least one opening and onto the polishing surface, wherein said at least one opening is of such a size so as to substantially cover an area of said polishing surface that is to be brought into engagement with the article by relative movement between the article and said polishing surface, and wherein said at least one opening is elongated substantially in a radial direction of said turntable.

29. A polisher comprising:

a turntable having a polishing surface positioned on a top surface thereof;

an article holder to hold an article to be polished by bringing the article into contact with said polishing surface; and a slurry dispenser to dispense slurry to said polishing surface, wherein said slurry dispenser includes a slurry dispensing member to receive slurry and dispense the slurry to the polishing surface, with said slurry dispensing member including a contact surface having at least one opening therein, such that said contact surface faces and contacts said polishing surface as the slurry is dispensed through said at least one opening and onto the polishing surface, wherein said at least one opening is of such a size so as to substantially cover an area of said polishing surface that is to be brought into engagement with the article by relative movement between the article and said polishing surface, wherein said slurry dispensing member is annular in shape and defines said at least one opening, with the diameter of said at least one opening being substantially equal to a maximum dimension of the article when measured along a diametrical direction of said turntable, wherein said slurry dispensing member surrounds said article carrier, and wherein said slurry dispensing member is rotatable about said article carrier.

30. A slurry dispenser for dispensing slurry to a polishing surface of a polishing apparatus, wherein an article is to be brought into contact with and moved relative to the polishing surface such that the article becomes polished, said slurry dispenser comprising:

a slurry dispensing member to receive slurry and dispense the slurry to the polishing surface, wherein the slurry dispensing member includes slurry dispensing openings through which the slurry is to be respectively supplied to areas on the polishing surface that correspond to respective portions of the article to be polished, and also includes a slurry supply adjuster to adjust an amount of slurry to be supplied to the areas through respective said slurry dispensing openings; and a slurry reservoir in fluid communication with said slurry dispensing member via a plurality of paths, with respective ones of said plurality of paths being in fluid communication with respective ones of said slurry dispensing openings, wherein said slurry supply adjuster includes a valve positioned within each of said plurality of paths to individually control an amount of slurry that is supplied from said slurry reservoir to said slurry dispensing openings.

31. A method for dispensing slurry to a polishing surface of a polishing apparatus in which an article to be polished is brought into contact with and moved relative to the polishing surface, such that the article becomes polished, said method comprising:

adjustably supplying slurry to respective areas on said polishing surface that are to be brought into contact with respective corresponding portions of said article, wherein adjustably supplying the slurry to respective areas on said polishing surface results in adjustably supplying the slurry to a central portion of said article independently of adjustably supplying the slurry to a peripheral portion of said article.

32. A method for dispensing slurry to a polishing surface of a polishing apparatus in which an article to be polished is brought into contact with and moved relative to the polishing surface, such that the article becomes polished, said method comprising:

adjustably supplying slurry to respective areas on said polishing surface that are to be brought into contact with respective corresponding portions of said article, wherein adjustably supplying the slurry to respective areas on said polishing surface includes feeding the slurry from a slurry reservoir through a plurality of paths, and then through respective slurry dispensing openings in a slurry dispenser member, and wherein adjustably supplying the slurry to respective areas on said polishing surface further includes individually adjusting an amount of the slurry fed from said slurry reservoir through each of said plurality of paths.

33. The method according to claim 32, wherein individually adjusting an amount of the slurry fed from said slurry reservoir through each of said plurality of paths includes individually adjusting the amount of slurry fed from said slurry reservoir through each of said plurality of paths such that a polishing rate becomes substantially uniform over an area of the article being polished.

34. A polisher comprising:

a turntable having a polishing surface positioned on a top surface thereof;

an article holder to hold an article to be polished by bringing the article into contact with said polishing surface;

a slurry dispenser to dispense the slurry to said polishing surface, wherein the slurry dispenser includes slurry dispensing openings radially arranged relative to said turntable, and also includes a slurry supply adjuster to adjust an amount of slurry to be supplied through said slurry dispensing openings to respective areas of said polishing surface; and a slurry reservoir in fluid communication with said slurry dispenser via a plurality of paths, with a respective one of said plurality of paths being in fluid communication with a respective one of said slurry dispensing openings, wherein said slurry supply adjuster includes a valve positioned within each of said plurality of paths to individually control an amount of slurry that is supplied from said slurry reservoir to said slurry dispensing openings.

35. A method for dispensing slurry to a polishing surface of a turntable of a polishing apparatus in which an article to be polished is brought into contact with and moved relative to the polishing surface such that the article becomes polished, said method comprising:

adjustably supplying slurry to respective areas on said polishing surface that are to be brought into contact with respective corresponding portions of said article, wherein adjustably supplying the slurry to respective areas on said polishing surface results in adjustably supplying the slurry to a central portion of said article independently of adjustably supplying the slurry to a peripheral portion of said article.

36. A method for dispensing slurry to a polishing surface of a turntable of a polishing apparatus in which an article to be polished is brought into contact with and moved relative to the polishing surface such that the article becomes polished, said method comprising:

adjustably supplying slurry to respective areas on said polishing surface that are to be brought into contact with respective corresponding portions of said article, wherein adjustably supplying the slurry to respective areas on said polishing surface includes feeding the slurry from a slurry reservoir through a plurality of paths, and then through respective slurry dispensing openings in a slurry dispenser, and wherein adjustably supplying the slurry to respective areas on said polishing surface further includes individually adjusting an amount of the slurry fed from said slurry reservoir through each of said plurality of paths.

37. The method according to claim 36, wherein individually adjusting an amount of the slurry fed from said slurry reservoir through each of said plurality of paths includes individually adjusting the amount of slurry fed from said slurry reservoir through each of said plurality of paths such that a polishing rate becomes substantially uniform over an area of the article being polished.

38. A polisher comprising:

a polishing member having a polishing surface;

an article holder to hold an article to be polished by bringing the article into contact with said polishing surface and moving said polishing member relative to the article;

a slurry dispenser to dispense the slurry to said polishing surface, wherein the slurry dispenser includes slurry dispensing openings through which the slurry is to be respectively supplied to areas on the polishing surface that correspond to respective portions of the article to be polished, and also includes a slurry supply adjuster to adjust an amount of slurry to be supplied to the areas through respective said slurry dispensing openings; and a slurry reservoir in fluid communication with said slurry dispenser via a plurality of paths, with a respective one of said plurality of paths being in fluid communication with a respective one of said slurry dispensing openings, wherein said slurry supply adjuster includes a valve positioned within each of said plurality of paths to individually control an amount of slurry that is supplied from said slurry reservoir to said slurry dispensing openings.

39. A slurry dispenser for dispensing slurry to a polishing surface of a polishing apparatus wherein an article is to be brought into contact with and moved relative to the polishing surface such that the article becomes polished, said slurry dispenser comprising:

a slurry dispensing member to receive slurry and dispense the slurry to the polishing surface, wherein said slurry dispensing member includes a contact surface to be brought into contact with the polishing surface as the slurry is dispensed, with said contact surface having at least one opening therein so that as the slurry is dispensed, the slurry exits from said at least one opening and passes through an interface of the polishing surface and said contact surface, wherein said slurry dispensing member includes a slurry container portion to hold the slurry therein, with said slurry container portion being in fluid communication with said at least one opening, and wherein said slurry container portion is divided into a plurality of container sections, and wherein said at least one opening includes a plurality of openings, with said plurality of openings being in fluid communication with said plurality of container sections, respectively.

40. The slurry dispenser according to claim 39, and further comprising a slurry supply devise to supply the slurry to said plurality of container sections.

41. The slurry dispenser according to claim 40, wherein said slurry supply device includes a plurality of slurry supply paths in fluid communication with said plurality of container sections, respectively, and an adjusting device to adjust the amount of slurry supplied to a respective one of said plurality of container sections.

42. The slurry dispenser according to claim 41, wherein said adjusting device includes valves positioned in respective ones of said plurality of slurry paths.

43. A polisher comprising:

a turntable having a polishing surface positioned on a top surface thereof;

an article holder to hold an article to be polished by bringing the article into contact with said polishing surface; and a slurry dispenser to dispense slurry to said polishing surface, wherein said slurry dispenser includes a slurry dispensing member to receive slurry and dispense the slurry to the polishing surface, with said slurry dispensing member including a contact surface to be brought into contact with the polishing surface as the slurry is dispensed, and with said contact surface having at least one opening therein so that as the slurry is dispensed, the slurry exits from said at least one opening and passes through an interface of the polishing surface and said contact surface, wherein said slurry dispensing member also includes a slurry container portion to hold the slurry therein, with said slurry container portion being in fluid communication with said at least one opening, and wherein said slurry container portion is divided into a plurality of container sections, and wherein said at least one opening includes a plurality of openings, with said plurality of openings being in fluid communication with said plurality of container sections, respectively.

44. The polisher according to claim 43, wherein said slurry dispenser further includes a slurry supply device to supply the slurry to said plurality of container sections.

45. The polisher according to claim 44, wherein said slurry supply device includes a plurality of slurry supply paths in fluid communication with said plurality of container sections, respectively, and an adjusting device to adjust the amount of slurry supplied to a respective one of said plurality of container sections.

46. The polisher according to claim 45, wherein said adjusting device includes valves positioned in respective ones of said plurality of slurry paths.

47. A polisher comprising:

a turntable having a polishing surface positioned on a top surface thereof;

an article holder to hold an article to be polished by bringing the article into contact with said polishing surface; and a slurry dispenser to dispense slurry to said polishing surface, wherein said slurry dispenser includes a slurry dispensing member to receive slurry and dispense the slurry to the polishing surface, with said slurry dispensing member including a contact surface to be brought into contact with the polishing surface as the slurry is dispensed, and with said contact surface having at least one opening therein so that as the slurry is dispensed, the slurry exits from said at least one opening and passes through an interface of the polishing surface and said contact surface, wherein said at least one opening is of such a size so as to substantially cover an area of said polishing surface that is to be brought into engagement with the article by relative movement between the article and said polishing surface, and wherein said at least one opening is elongated substantially in a radial direction of said turntable.

48. A polisher comprising:

a turntable having a polishing surface positioned on a top surface thereof;

an article holder to hold an article to be polished by bringing the article into contact with said polishing surface; and a slurry dispenser to dispense slurry to said polishing surface, wherein said slurry dispenser includes a slurry dispensing member to receive slurry and dispense the slurry to the polishing surface, with said slurry dispensing member including a contact surface to be brought into contact with the polishing surface as the slurry is dispensed, and with said contact surface having at least one opening therein so that as the slurry is dispensed, the slurry exits from said at least one opening and passes through an interface of the polishing surface and said contact surface, wherein said at least one opening is of such a size so as to substantially cover an area of said polishing surface that is to be brought into engagement with the article by relative movement between the article and said polishing surface, wherein said slurry dispensing member is annular in shape and defines said at least one opening, with the diameter of said at least one opening being substantially equal to a maximum dimension of the article when measured along a diametrical direction of said turntable, wherein said slurry dispensing member surrounds said article carrier, and wherein said slurry dispensing member is rotatable about said article carrier.

* * * * *